US008375468B2

(12) United States Patent
Okamoto et al.

(10) Patent No.: US 8,375,468 B2
(45) Date of Patent: Feb. 19, 2013

(54) CLOTHING FOR UPPER HALF OF BODY

(75) Inventors: Tomoko Okamoto, Kyoto (JP); Mayumi Umemoto, Kyoto (JP)

(73) Assignee: Wacoal Corporation, Kyoto (JP)

( * ) Notice: Subject to any disclaimer, the term of this patent is extended or adjusted under 35 U.S.C. 154(b) by 46 days.

(21) Appl. No.: 13/060,311

(22) PCT Filed: Jul. 7, 2009

(86) PCT No.: PCT/JP2009/062368

§ 371 (c)(1),
(2), (4) Date: Mar. 28, 2011

(87) PCT Pub. No.: WO2010/024046

PCT Pub. Date: Mar. 4, 2010

(65) Prior Publication Data

US 2011/0203029 A1 Aug. 25, 2011

(30) Foreign Application Priority Data

Aug. 27, 2008 (JP) ..... P2008-218489

(51) Int. Cl.
*A41D 13/00* (2006.01)

(52) U.S. Cl. ..... 2/69

(58) Field of Classification Search ..... 2/69, 44, 2/79, 115, 92, 83, 78.3, 243.1; 482/121, 482/124, 74, 131, 139

See application file for complete search history.

(56) References Cited

U.S. PATENT DOCUMENTS

| | | | | |
|---|---|---|---|---|
| 5,367,708 | A * | 11/1994 | Fujimoto | 2/22 |
| 5,659,895 | A * | 8/1997 | Ford, Jr. | 2/2.11 |
| 5,829,058 | A * | 11/1998 | Dicker et al. | 2/69 |
| 5,937,442 | A | 8/1999 | Yamaguchi et al. | |
| 6,047,406 | A * | 4/2000 | Dicker et al. | 2/69 |
| 2009/0265828 | A1 | 10/2009 | Semba et al. | |

FOREIGN PATENT DOCUMENTS

| | | |
|---|---|---|
| JP | 9-250008 | 9/1997 |
| JP | 2004-263362 | 9/2004 |
| JP | 2005-248391 | 9/2005 |
| JP | 2006-291399 | 10/2006 |
| JP | 4-061336 | 3/2008 |

OTHER PUBLICATIONS

English Translation of International Preliminary Report on Patentability (IPRP—Chapter 1) PCT/JP2009/062368 mailed Apr. 21, 2011. Office Action from Japanese Application No. 2008-218489 (Publication No. JP 2010-53472A).
"http://thumbnail.image.rakuten.co.jp/s/?@0_mall/haturatu/cabinet/ikou_20090618/img10552457669.gif" (http//item.rakuten.co.jp/haturatu/869965/#869965). (See B1).

* cited by examiner

*Primary Examiner* — Tejash Patel
(74) *Attorney, Agent, or Firm* — Leydig, Voit & Mayer, Ltd.

(57) ABSTRACT

Clothing for the upper half of a body is provided, which makes it possible to reduce distortions of the body and alleviate fatigue by simply wearing the clothing and leading a usual life.

A distortion reducing portion formed with a plurality of strip portions exhibiting a constrictive power stronger than that of a main body cloth is provided. The distortion reducing portion comprises one pair of strip portion sets each having at least three strip portions aligned so as to incline in the same direction. The pair of strip portion sets are arranged symmetrically while intersecting each other. The clothing also has at least two surrounded portions surrounded by a plurality of strip portions. The structure provided with such a distortion reducing portion improves the activity balance between the spinal column and muscles of the wearer. This corrects distortions in the body of the wearer and reduces the difference in hardness of muscles between the right side and left side in the back part of the wearer.

4 Claims, 6 Drawing Sheets

*Fig.5*

| | Example1 | | | Example2 | | | Example3 | | |
|---|---|---|---|---|---|---|---|---|---|
| Wearer | Z | X | Y | Z | X | Y | Z | X | Y |
| A | −1.17 | −2.16 | −0.81 | −1.43 | (−0.08) | (2.55) | 1.48 | −0.30 | −1.14 |
| B | (−2.51) | (4.14) | −1.08 | −0.49 | (4.31) | −1.26 | (0.05) | (0.28) | −1.61 |
| C | 0.47 | −1.04 | (−2.13) | 1.95 | 0.70 | −0.62 | (2.52) | −2.09 | (−1.70) |
| D | −0.62 | −2.46 | (0.14) | 0.31 | −2.57 | 1.47 | 0.53 | −0.97 | 0.25 |
| E | 1.67 | (0.35) | −0.47 | (4.01) | −2.02 | 0.35 | −0.32 | (2.74) | −1.05 |
| F | (0.20) | 3.85 | −1.69 | 0.28 | 2.30 | −1.35 | 0.91 | 1.63 | −0.36 |
| G | −0.36 | 0.64 | −0.36 | (−0.10) | −2.86 | (0.26) | −0.35 | −0.78 | (0.07) |

*Fig.6*

| | Example1 | Example2 |
|---|---|---|
| Z | 3 (Evaluation : good) | 2 (Evaluation : bad) |
| X | 3 (Evaluation : good) | 3 (Evaluation : good) |
| Y | 5 (Evaluation : good) | 3 (Evaluation : good) |

CLOTHING FOR UPPER HALF OF BODY

TECHNICAL FIELD

The present invention relates to clothing for the upper half of a body, which is provided with a main body cloth covering the upper half of the body of a wearer.

BACKGROUND ART

Conventionally known as a technique in such a field is Japanese Patent Application Laid-Open No. 2004-263362. The clothing for the upper half of a body disclosed in the publication is formed as a whole by a stretchable material, while a high-pressure area exhibiting a strong tightening force is formed like a band in at least a region corresponding to the back of a wearer. This makes it easier for the wearer to keep a posture of sticking out chest with a straight back, thereby supporting correct exercises of the wearer.

CITATION LIST

Patent Literature

Patent Literature 1: Japanese Patent Application Laid-Open No. 2004-263362

SUMMARY OF INVENTION

Technical Problem

However, the prior art disclosed in the above-mentioned Patent Literature 1, which exerts a strong tightening force so as to make the wearer attain a posture of sticking out chest with a straight back, has been problematic in that it imparts a feeling of strangeness to the wearer when continuously worn on a daily basis.

Generally speaking, no one is free of distortions of the body. According to NIWA, Noboru, Good Doctor's Easy to Understand Posture Correction (Dobunshoin), there is likely to occur a cycle in which distortions in the body generate asymmetrical postures/actions, the latter break the balance of activities between the spinal column and muscles, thus yielding fatigue and stiffness, and such a loss in the activity balance between the spinal column and muscles leads to distortions in the body. For preventing the above-mentioned cycle from occurring, it is desirable to take a long bath to ease fatigue sufficiently or do stretching exercises. However, such takes time or effort, whereby there has been a demand for easily preventing the fatigue and stiffness of the body while keeping a normal life.

For solving the problem mentioned above, it is an object of the present invention to provide clothing for the upper half of a body, which makes it possible to reduce distortions of the body and alleviate fatigue by simply wearing the clothing and leading a usual life.

Solution to Problem

The clothing for the upper half of a body in accordance with the present invention is the clothing for the upper half of a body provided with a main body cloth covering the upper half of the body of a wearer; wherein a part of the main body cloth covering an upper side of a back of the wearer is provided with a distortion reducing portion adapted to reduce a distortion of the wearer, the distortion reducing portion being formed with a plurality of strip portions exhibiting a constrictive power stronger than that of the main body cloth; wherein the distortion reducing portion comprises a pair of strip portion sets each having at least three strip portions aligned so as to incline in the same direction; and wherein the pair of strip portion sets are arranged symmetrically while intersecting each other, so as to form at least two surrounded portions surrounded by a plurality of strip portions.

This clothing for the upper half of a body has a distortion reducing portion formed with a plurality of strip portions exhibiting a constrictive power stronger than that of the main body cloth. The distortion reducing portion comprises a pair of strip portion sets each having at least three strip portions aligned so as to incline in the same direction. The pair of strip portion sets are arranged symmetrically while intersecting each other, so as to form at least two surrounded portions surrounded by a plurality of strip portions. The clothing for the upper half of a body comprises thus constructed distortion reducing portion and therefore can improve the activity balance between the spinal column and muscles of the wearer. This corrects distortions in the body of the wearer and reduces the difference in hardness of muscles between the right side and left side in the back part of the wearer. Since the arrangement of the strip portions exhibiting a stronger constrictive power in the clothing for the upper half of a body in accordance with the present invention does not exert a strong tightening force so as to make the wearer attain a posture of sticking out chest with a straight back, clothing for the upper half of a body which can continuously be worn on a daily basis can be achieved.

Here, the distortion reducing portion may be disposed at a position corresponding to the seventh and eighth thoracic vertebrae, each surrounded portion being formed into a rhombus.

Preferably, the distortion reducing portion is formed such as to have a narrower width toward the lower side.

Preferably, at least one pair of the strip portions extend from respective positions corresponding to the left and right shoulders of the wearer to obliquely lower sides.

Preferably, a part of the main body cloth covering a lower side of the back of the wearer is further formed with strip portion pairs having respective apexes at positions corresponding to the fourth and fifth lumbar vertebrae of the wearer and extending laterally therefrom to obliquely lower sides. This can support the gravity from the upper side while dispersing it.

Advantageous Effects of Invention

When the wearer simply wears the clothing for the upper half of a body in accordance with the present invention and leads a usual life, it supports a group of muscles in the back of the wearer such as to make them approach symmetrical movements, and thus can reduce distortions in the body of the wearer and alleviate fatigue.

BRIEF DESCRIPTION OF DRAWINGS

[FIG. 5] is a chart illustrating differences in absolute values of measured results in a function validation test; and

[FIG. 6] is a chart illustrating evaluations by the function validation test.

DESCRIPTION OF EMBODIMENTS

Figure 1:
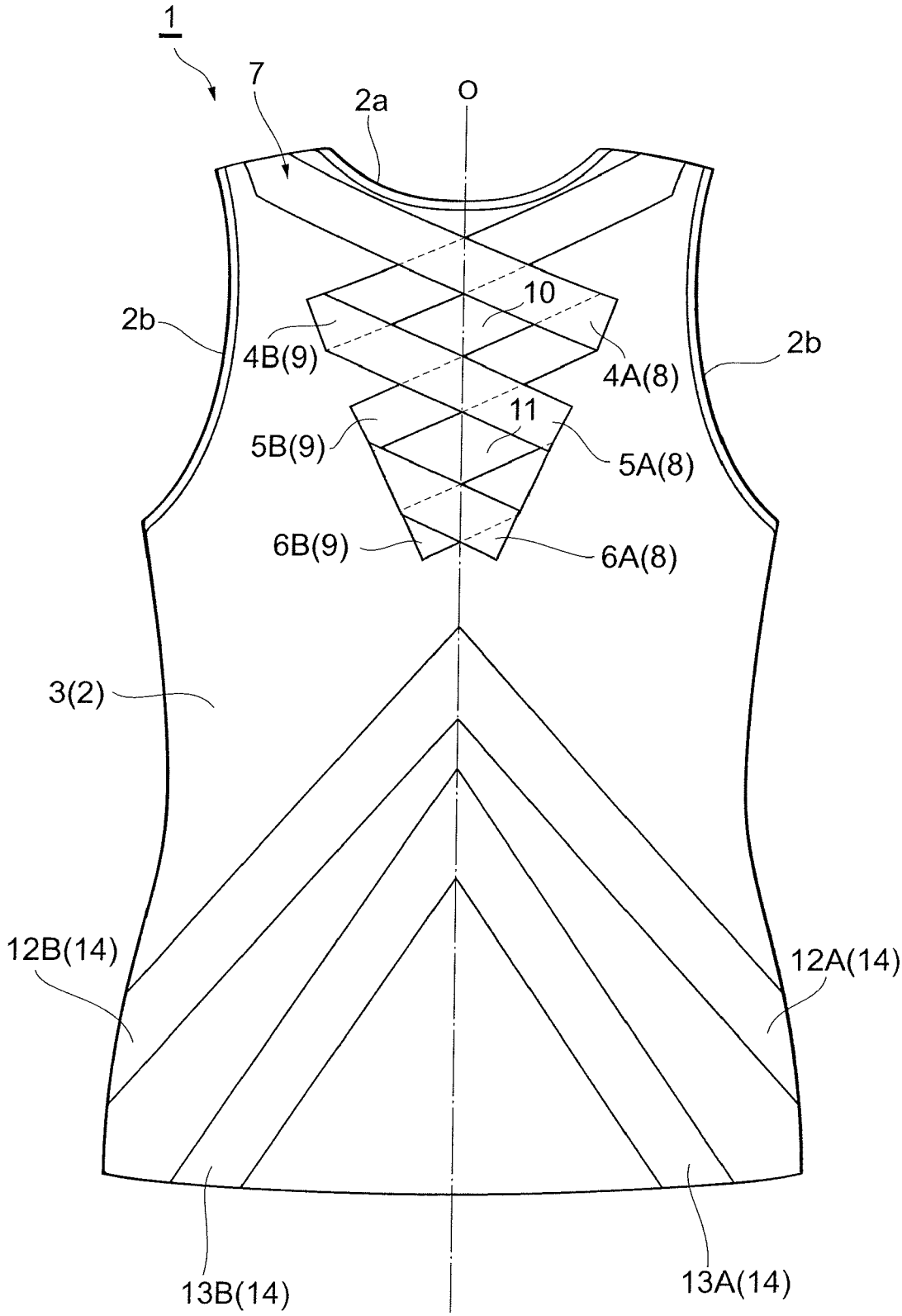
[FIG. 1] is a rear view of the clothing for the upper half of a body in accordance with an embodiment of the present invention.

In the following, preferred embodiments of the clothing for the upper half of a body in accordance with the present invention will be explained with reference to the drawings. In the explanation of the drawings, the same or equivalent constituents will be referred to with the same signs, while omitting their overlapping descriptions. FIG. 1 is a rear view illustrating the clothing for the upper half of a body in accordance with an embodiment of the present invention.

As illustrated in FIG. 1, the clothing for the upper half of a body 1 is utilized as underwear (e.g., a sleeveless shirt) worn directly on the skin in daily life. The clothing for the upper half of a body 1 has a shirt main body 2 covering the upper half of the body of a wearer, while the shirt main body 2 has a front part (not shown) covering the front side of the upper half of the body and a rear part 3 covering the back side of the upper half of the body.

A neck 2*a*, which is an opening for exposing the head of the wearer, is formed at the center of the upper part of the shirt main body, while armholes 2*b*, which are openings for exposing the left and right arms of the wearer, are formed at upper parts on the left and right sides of the shirt main body 2. The front part and rear part 3 are sewn together at upper and side end portions which are free of the neck 2*a* and armholes 2*b*, so as to construct the shirt main body 2.

As seen from the rear face, the rear part 3 curves inward at the portions forming the neck 2*a* and armholes 2*b*. Also, as seen from the rear face, the rear part 3 is formed such as to be depressed mildly inward at the side end portions.

In the clothing for the upper half of a body 1 in accordance with this embodiment, the outer surface of the main body cloth of the rear part 3 is provided with a spinal pantograph structure (distortion reducing portion) 7 having a plurality of strip portions 4A, 4B, 5A, 5B, 6A, 6B exhibiting a constrictive power stronger than that of the main body cloth.

Figure 2:
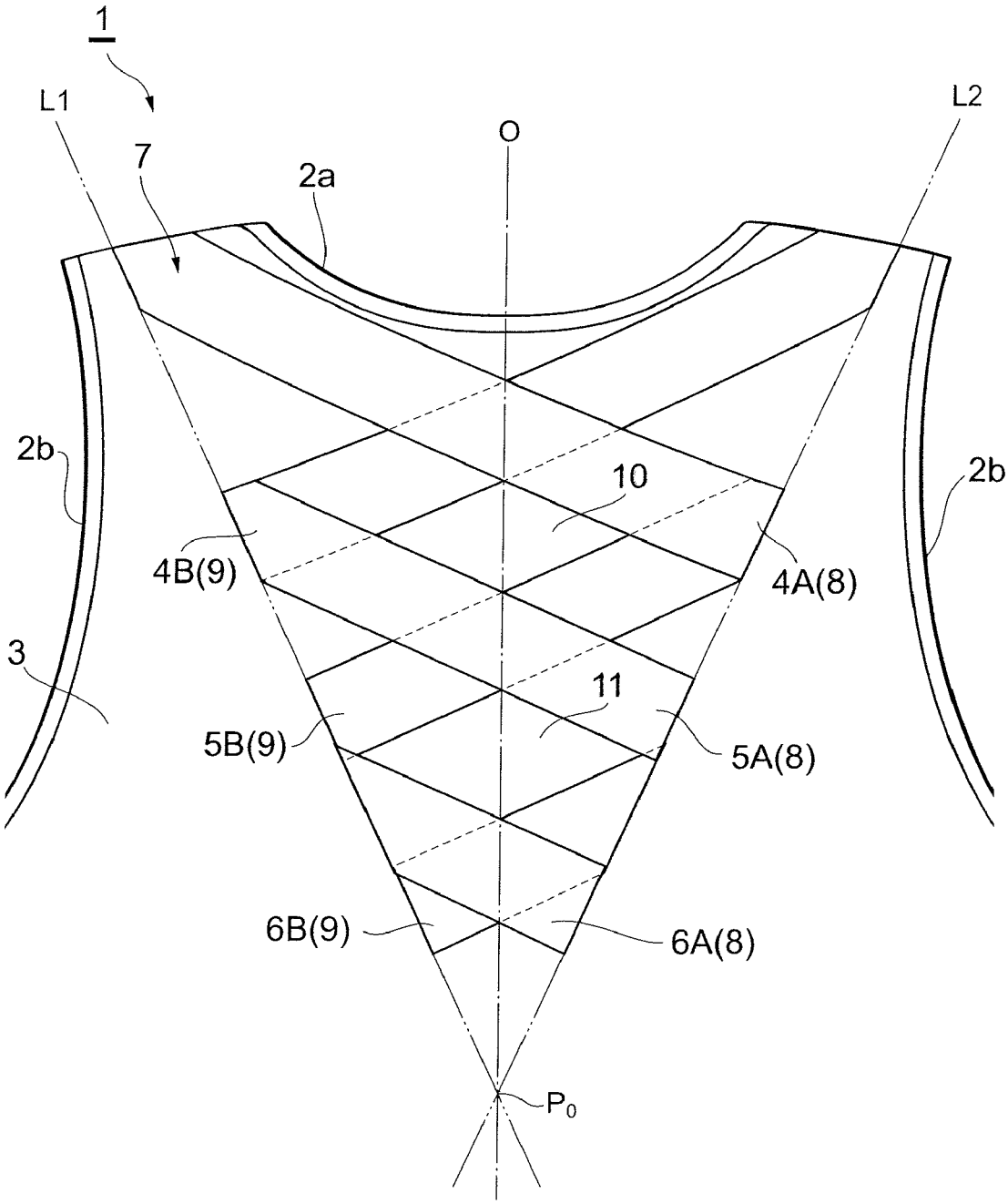
[FIG. 2] is a rear view illustrating a spinal pantograph structure in FIG. 1 under magnification.

FIG. 2 is a rear view illustrating the spinal pantograph structure in FIG. 1 under magnification. In FIG. 2, a center line O vertically extending at the lateral center of the clothing for the upper half of a body 1 is indicated by a dash-single-dot line, while virtual lines L1, L2, which locate their origin at a point P0 on the center line O and incline their upper sides outward so as to form a letter V, are indicated by dash-double-dot lines.

As illustrated in FIG. 2, the spinal pantograph structure 7 comprises a pair of strip portion sets 8, 9 each having at least three strip portions 4A, 5A, 6A; 4B, 5B, 6B which are aligned so as to incline in the same direction. For example, the three strip portions 4A, 5A, 6A constituting the strip portion set 8 extend in a direction orthogonal to the virtual line L2, while the three strip portions 4B, 5B, 6B constituting the strip portion set 9 extend in a direction orthogonal to the virtual line L1. End parts of the strip portions 4A, 4B, 5A, 5B, 6A, 6B are cut so as to fall inside of the two virtual lines. The spinal pantograph structure 7 is arranged at a position corresponding to the seventh and eighth thoracic vertebrae.

The strip portion set 8 has the strip portion 4A (also referred to as "first strip portion" in the following) arranged at the upper stage, the strip portion 5A (also referred to as "second strip portion" in the following) arranged at the middle stage, and the strip portion 6A (also referred to as "third strip portion" in the following) arranged at the lower stage. The strip portions 4A, 5A, 6A are arranged at predetermined intervals. The predetermined interval may be about the width of each of the strip portions 4A, 5A, 6A. The first strip portion 4A extends from the left shoulder part (the upper left end of the rear part 3) so as to incline to the lower right side. The strip portions 4A, 5A, 6A become shorter from the upper stage to the lower stage in sequence.

The strip portion set 9 has the strip portion 4B (also referred to as "first strip portion" in the following) arranged at the upper stage, the strip portion 5B (also referred to as "second strip portion" in the following) arranged at the middle stage, and the strip portion 6B (also referred to as "third strip portion" in the following) arranged at the lower stage. The strip portions 4B, 5B, 6B are arranged at predetermined intervals. The predetermined interval may be about the width of each of the strip portions 4B, 5B, 6B. The first strip portion 4B extends from the right shoulder part (the upper right end of the rear part 3) so as to incline to the lower left side. The strip portions 4B, 5B, 6B become shorter from the upper stage to the lower stage in sequence.

The one pair of strip portion sets 8, 9 are arranged symmetrically, so that the first strip portions 4A, 4B intersect each other at the center, the second strip portions 5A, 5B intersect each other at the center, and the third strip portions 6A, 6B intersect each other at the center. The right end parts of the first and second strip portions 4A, 5B are formed at the same position, the left end parts of the second and third strip portions 5B, 6A are formed at the same position, the left end parts of the first and second strip portions 4B, 5A are formed at the same position, and the right end parts of the second and third strip portions 5A, 6B are formed at the same position. However, it is not necessary for the end parts of the strip portions to be formed at the same position. For example, the strip portions may be formed such as to intersect each other on the end part side.

The spinal pantograph structure 7 has a rhombic surrounded portion 10 surrounded by the first strip portions 4A, 4B and second strip portions 5A, 5B and a rhombic surrounded portion 11 surrounded by the second strip portions 5A, 5B and third strip portions 6A, 6B. In this embodiment, the area of the surrounded portion 11 at the lower stage is greater than that of the surrounded portion 10 at the upper stage. The area of the surrounded portion 11 at the lower stage may also be equal to or smaller than that of the surrounded portion 10 at the upper stage. The surrounded portions 10, 11 may also be in rhombic forms with rounded corners or other forms.

A bare plain stitch knitted material composed of cotton and polyurethane can be used as the main body cloth of the rear part 3, while a satin net (having a width of 3 cm, for example) composed of nylon and polyurethane (e.g., 470 dtex) can be used as the strip portions 4A, 4B, 5A, 5B, 6A, 6B exhibiting a constrictive power stronger than that of the main body cloth. The strip portions 4A, 4B, 5A, 5B, 6A, 6B are sewn onto the main body cloth of the rear part 3. The strip portions may also be attached to the main body cloth by other methods, examples of which include bonding with adhesives, pressure bonding which performs attaching by exerting a pressure, and thermal fusion bonding which achieves attaching by heating, any of which may be combined.

As an example of the order of attaching the strip portions 4A, 4B, 5A, 5B, 6A, 6B, the third strip portion 6B, third strip portion 6A, second strip portion 5B, second strip portion 5A, first strip portion 4B, and first strip portion 4A may be attached in this order.

In the clothing for the upper half of a body 1 in accordance with this embodiment, the main body cloth of the rear part 3 is provided with not only the spinal pantograph structure but also a gravity dispersing structure 14 having a plurality of strip portions 12A, 12B, 13A, 13B exhibiting a constrictive power stronger than that of the main body cloth.

The gravity dispersing structure 14 comprises strip portion pairs 12A, 12B; 13A, 13B having respective apexes at positions corresponding to the fourth and fifth lumbar vertebrae of the wearer and extending laterally therefrom to obliquely lower sides so as to form inverted V's (mountains). The pair of strip portions 12A, 12B arranged at the upper stage extend from their apex on the center line O to side ends on the lower side of the rear part 3. The pair of strip portions 13A, 13B arranged at the lower stage extend from their apex on the center line O to the lower end of the rear part 3 while approaching its side portions.

In thus constructed clothing for the upper half of a body 1, the spinal pantograph structure 7 comprising a plurality of strip portions 4A, 4B, 5A, 5B, 6A, 6B exhibiting a constrictive power stronger than that of the main body cloth of the rear part 3 is formed, a pair of strip portion sets 8, 9 each having three strip portions aligned so as to incline in the same direction are arranged symmetrically while intersecting each other, and a plurality of rhombic surrounded portions 10, 11 surrounded by a plurality of strip portions 4A, 4B, 5A, 5B, 6A, 6B are formed. The clothing for the upper half of a body 1 is provided with such spinal pantograph structure 7 and thus can adjust the balance of muscles between the right side and left side in the back part of the wearer by following movements of the backbone of the wearer and pulling it back to the center of the trunk. This corrects distortions in the body of the wearer and reduces the difference in hardness of muscles between the right side and left side in the back part of the wearer. Since the arrangement of the strip portions 4A, 4B, 5A, 5B, 6A, 6B exhibiting a stronger constrictive power in the clothing for the upper half of a body 1 in accordance with the present invention does not exert a strong tightening force so as to make the wearer attain a posture of sticking out chest with a straight back, clothing for the upper half of a body which can continuously be worn on a daily basis can be achieved.

The clothing for the upper half of a body 1 is also provided with the gravity dispersing structure 14 in which a plurality of strip portions 12A, 12B, 13A, 13B having a constrictive power stronger than that of the main body cloth are arranged like inverted V's, and thus can support the spinal column in the low back of the wearer so as to cover it, thereby dispersing the load from the upper side and the gravity.

The clothing for the upper half of a body 1 is provided with the spinal pantograph structure 7 and the gravity dispersing structure 14, and thus can stably support and fix the low back of the wearer and further promote symmetrical movements of the upper half of the body.

The present invention has been explained specifically with reference to its embodiment in the foregoing but is not limited thereto. The clothing for the upper half of a body 1 may be sleeveless, short-sleeved, or long-sleeved, for example, without being limited in terms of its sleeve length as long as it has shoulders.

Though the clothing for the upper half of a body 1 is provided with the spinal pantograph structure 7 and the gravity dispersing structure 14, the gravity dispersing structure 14 may be omitted. The number of strip portions arranged like mountains in the gravity dispersing structure may also be 1 or 3 or more.

The strip portions (constrictive portions) may be attached to the main body cloth by sewing or bonding. The strip portions may also be formed as being grafted to the main body cloth. Strip portions and the main body may be formed integrally by changing the knitting method so as to provide strip portions exhibiting a strong constrictive power, applying a urethane resin (by printing, for example), or opal finishing.

The shirt main body 2 may be constituted by a knitted fabric which is not required to be sewn up at side end portions or upper and side end portions.

Though the first strip portions 4A, 4B extend from the left and right shoulders to obliquely lower sides in the above-mentioned embodiment, the positions corresponding to the left and right shoulders may be free of the strip portions as in clothing for the upper half of a body 22 in accordance with Example 3 (see FIG. 4) which will be explained later, for example.

The strip portions have the same width in the above-mentioned embodiment but may have different widths. Though the strip portions are formed separately, a single strip member may be folded back so as to form a plurality of strip portions. For example, the first, second, and third strip portions 4A, 5B, 6A may be formed by folding back a single strip member. Similarly, the first, second, and third strip portions 4B, 5A, 6B may be formed by folding back a single strip member.

Example 1

The present invention will now be explained in further detail with reference to examples but is not limited thereto. Explanations identical to those in the clothing for the upper half of a body 1 in accordance with the above-mentioned embodiment will be omitted.

Figure 3:
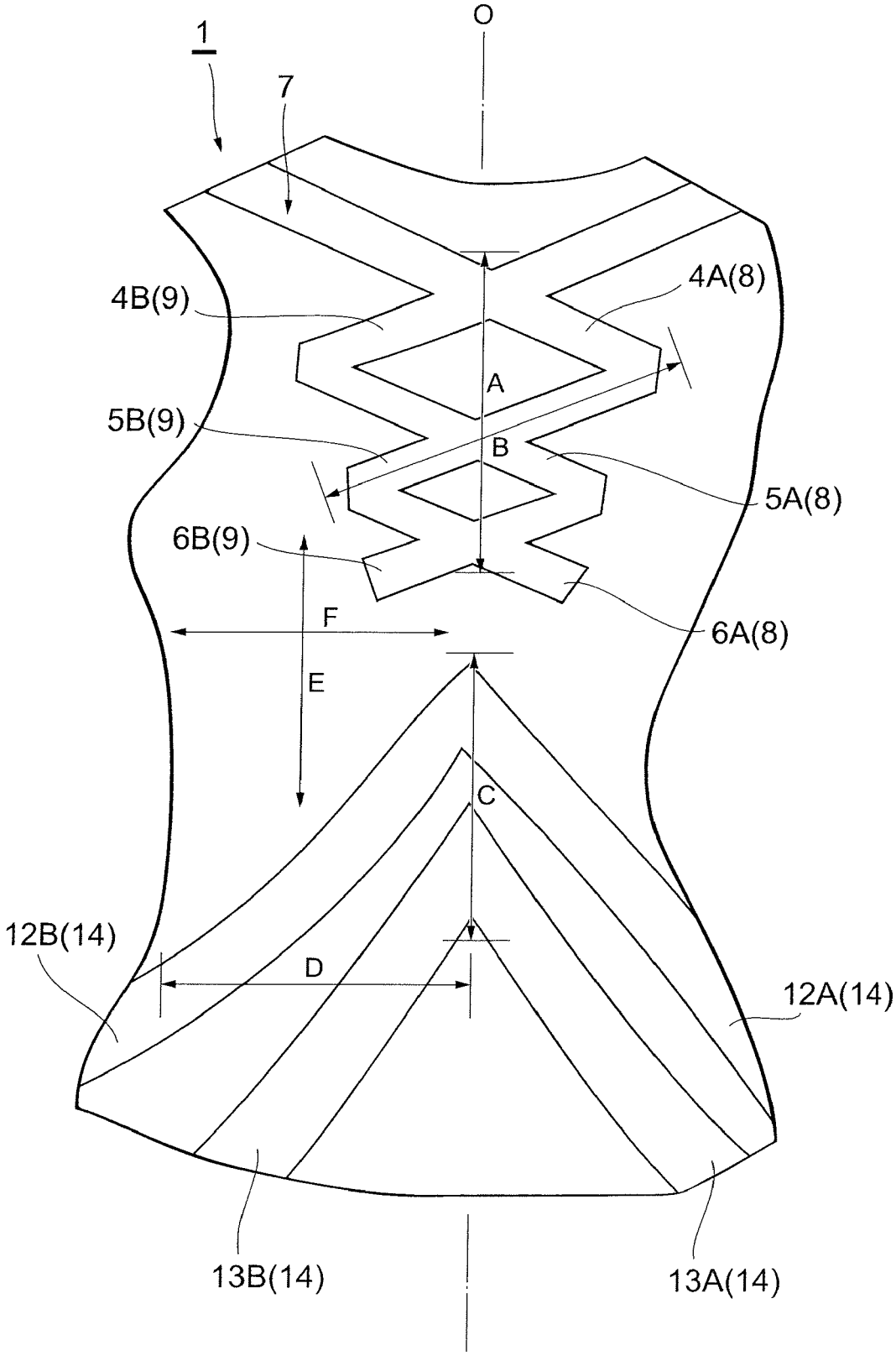
[FIG. 3] is a rear view of the clothing for the upper half of a body in accordance with an example of the present invention, illustrating test locations of a tensile test.

FIG. 3 is a rear view of the clothing for the upper half of a body in accordance with an example of the present invention, illustrating test locations of a tensile test. In the clothing for the upper half of a body 1 in accordance with Example 1, a bare plain stitch knitted fabric (whose fiber composition is constituted by 89% of cotton and 11% of polyurethane) is used as the main body cloth of the rear part 3. Employed as the cloth for the strip portions of the spinal pantograph structure 7 is a satin net (Raschel knit fabric whose fiber composition is constituted by 67.6 of nylon and 32.4% of polyurethane). Used as the cloth for the strip portions of the gravity dispersing structure 14 is a satin net (Raschel knit fabric whose fiber composition is constituted by 86% of nylon and 14% of polyurethane).

An operation of extending the clothing for the upper half of a body 1 to an elongation of 40% and immediately thereafter returning it to the original position at the same rate was repeated three times for a given test location. The tensile force (extending force) was measured at each test location when the elongation of the test location became 40% at the third time.

Test Method

Testing machine: Constant-rate-of-extension type tensile testing machine

Support: Supported by needles penetrating at two points. The distance between the two points was 15 cm.

Tension rate: 30 cm/min

Initial load: 0 cN

Number of repetitions: 3

Time after extension: 0 sec

Time after resuming the original position: 0 sec

FIG. 3 illustrates test locations A to F, in which the test location A is a location connecting the intersection between the first strip portions 4A, 4B and the intersection between the third strip portions 6A, 6B, the test location B is a location connecting both longitudinal end parts of the second strip portion 5B, the test location C is a location connecting two apex parts of the gravity dispersing structure 14, the test location D is a location laterally extending over the strip portions 12B, 13B, the test location E is a location vertically extending between the lower side of the spinal pantograph structure 7 and the upper side of the gravity dispersing structure 14 on the outside of the center line O, and the test location F is a location laterally extending in the space between the lower side of the spinal pantograph structure 7 and the upper side of the gravity dispersing structure 14 on the outside of the center line O.

As a result of the tensile test at the test locations A to F by the above-mentioned test method, the tensile force was 430 cN, 753 cN, 654 cN, 423 cN, 216 cN, and 273 cN at the test locations A, B, C, D, E, and F, respectively.

The extending force ratios at the test locations are preferably such that the extending force at the test location A is 1.5 to 2.5 times that at the test location E, the extending force at the test location C is 1.0 to 2.0 times that at the test location A, and the extending force at the test location D is 1.0 to 2.0 times that at the test location F.

Figure 4:
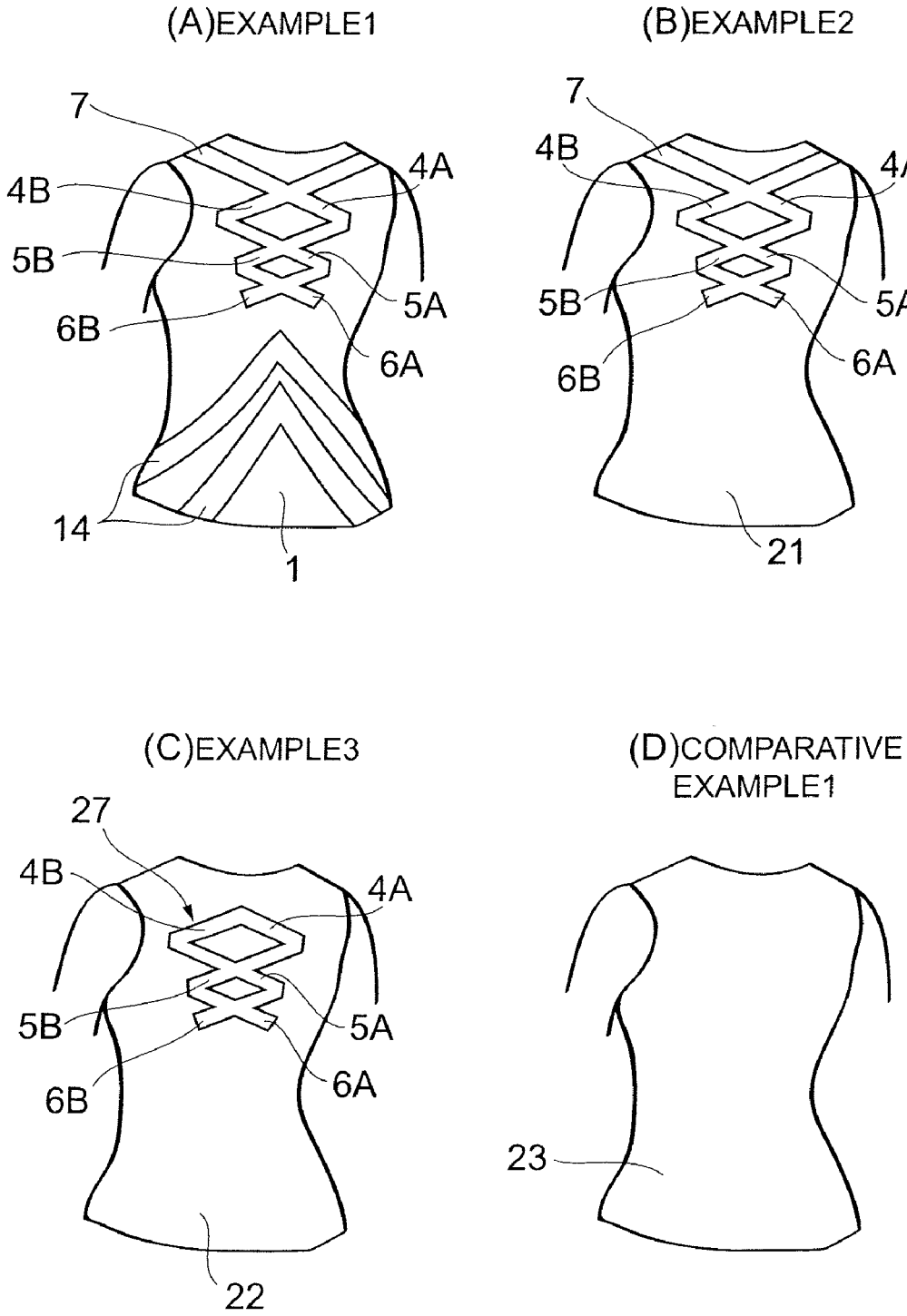
[FIG. 4] is a rear view of the clothing for the upper half of a body in accordance with examples of the present invention and the clothing for the upper half of a body in accordance with a comparative example.

Next, a function validation test was carried out for the clothing for the upper half of a body 1, 21, 22 in accordance with Examples 1 to 3 of the present invention and the clothing for the upper half of a body 23 in accordance with Comparative Example 1. FIG. 4 is a rear view of the clothing for the upper half of a body in accordance with examples of the present invention and the clothing for the upper half of a body in accordance with the comparative example.

Example 1 illustrated in FIG. 4(A) is the clothing for the upper half of a body 1 having the pantograph structure 7 and gravity dispersing structure 14. Example 2 illustrated in FIG. 4(B) is the clothing for the upper half of a body 21 having the pantograph structure 7 without the gravity dispersing structure 14. Example 3 illustrated in FIG. 4(C) is the clothing for the upper half of a body 22 having a pantograph structure 27 in a form different from that in Examples 1 and 2 and no gravity dispersing structure 14. The pantograph structure 27 of Example 3 has a structure in which the intersection between the first strip portions 4A, 4B forms an upper end part, while the first strip portions 4A, 4B fall short of reaching the left and right shoulders. Comparative Example 1 illustrated in FIG. 4(D) is the clothing for the upper half of a body 23 constituted by the main body cloth alone (having no strip portions exhibiting a strong constrictive power).

Then, the function validation test was carried out for the clothing for the upper half of a body 1, 21, 22 in accordance with Examples 1 to 3 of the present invention and the clothing for the upper half of a body 23 in accordance with Comparative Example 1. Using an optical reflection type motion capture system manufactured by Vicon as a measuring apparatus, the function validation test was carried out for measuring the posture of a wearer of the clothing for the upper half of a body at the time of walking. In the function validation test, the wearer of the clothing for the upper half of a body walked at a speed of 3.8 km/hr, and the measurement was started after the wearer had walked for 90 sec and ended after the walking of 12 sec.

In the function validation test, markers detectable by the measuring apparatus were attached near the manubrium sterni, xiphoid process, seventh cervical vertebra, and tenth thoracic vertebra, respectively, so as to serve as a body segment, and near the left anterior iliac spine, right anterior iliac spine, left posterior iliac spine, and right posterior iliac spine, respectively, so as to serve as a pelvic segment.

Then, the left/right angle difference Z (difference between the leftward rotational angle from a reference position and the rightward rotational angle from the reference position) of convolution which is an action of rotating about the trunk of the wearer, the maximum angle X of forward/backward bending of the wearer, and the range Y of side bending of the wearer were calculated from the relative relationship between the body segment and pelvic segment. The left/right angle difference Z of convulsion, maximum angle X of forward/backward bending, and range Y of side bending indicate better walking postures as they are closer to 0°. The above-mentioned segment is an action unit based on the four points where the markers are attached. The left/right angle difference Z of convulsion, maximum angle X of forward/backward bending, and range Y of side bending may be calculated according to the relative relationship of midpoints between the four points where the markers are attached, for example.

Here, the convolving action of the wearer was evaluated by the left/right angle difference Z, while the side bending action was evaluated by the range of action instead of the angle difference. In the case of a wearer with a distorted skeleton, a state where the wearer inclines leftward or rightward can be considered normal, whereby a decrease in the range (amplitude) of side bending action can be regarded as a reduction in distortions.

In the function validation test, for seven wearers, comparison was made between the case where the clothing for the upper half of a body in accordance with the present invention (Examples 1 to 3) was worn and the case where the clothing for the upper half of a body made of a main body cloth alone (having no strip portions exhibiting a strong constrictive power) (Comparative Example 1) was worn.

For each of the left/right angle difference Z of convolution, maximum angle X of forward/backward bending, and range Y of side bending, the absolute value of each measurement result of Examples 1 and 2 and the absolute value of measurement result of Comparative Example 1 were compared with each other, the maximum and minimum values of the absolute value of the difference were excluded, and the evaluation was made according to the remaining measurement data of five wearers.

FIG. 5 is a chart illustrating differences in absolute values of measured results in the function validation test, while FIG. 6 is a chart illustrating evaluations by the function validation test. In FIG. 5, the maximum and minimum absolute values are parenthesized. As FIGS. 5 and 6 illustrate, Example 2 having the pantograph structure 7 has been found effective in improving the walking posture in terms of the maximum angle X of forward/backward bending and range Y of side bending. Example 1 having the pantograph structure 7 and gravity dispersing structure 14 has been found effective in improving the walking posture in terms of the left/right angle difference Z of convolution, maximum angle X of forward/backward bending, and range Y of side bending. Further, the number of people found effective in terms of the left/right angle difference Z and range Y of side bending is greater in Example 1 than in Example 2.

It is seen in Example 1 that average values of five effective people in terms of the left/right angle difference Z of convolution, maximum angle X of forward/backward bending, and range Y of side bending decrease by 0.72°, 1.89°, and 0.88°, respectively; and that, letting the pelvic position be constant, the distance from the body center O to a shoulder end be 20 cm, and the distance from the pelvis to the top part of the head be 70 cm, the left/right difference in convulsion decreases by 0.25 cm at the shoulder end, the maximum forward bending decreases by 2.31 cm at the top part of the head, and the range of side bending (swinging range) decreases by 1.08 cm at the top part of the head.

REFERENCE SIGNS LIST

1 . . . clothing for the upper half of a body; 2 . . . shirt main body; 3 . . . rear part; 4A, 4B . . . first strip portion (strip portion); 5A, 5B . . . second strip portion (strip portion); 6A, 6B . . . third strip portion (strip portion); 7, 27 . . pantograph structure (distortion reducing portion); 8, 9 . . . strip portion set; 10, 11 . . . surrounded portion; 12A, 12B, 13A, 13B . . . strip portion; 14 . . . gravity dispersing structure

The invention claimed is:

1. Clothing for the upper half of a body provided with a main body cloth covering the upper half of the body of a wearer;

wherein a part of the main body cloth covering an upper side of a back of the wearer comprises a distortion reducing portion adapted to reduce a distortion of the wearer, the distortion reducing portion having an upper side and a lower side, wherein the distortion reducing portion is formed to have a narrower width toward the lower side than the width toward the upper side, the distortion reducing portion being formed with a plurality of strip portions exhibiting a constrictive power stronger than that of the main body cloth;

wherein the distortion reducing portion comprises a pair of strip portion sets each having at least three strip portions aligned so as to incline in the same direction; and wherein the pair of strip portion sets are arranged symmetrically while intersecting each other, so as to form at least two surrounded portions surrounded by a plurality of strip portions.

2. The clothing for the upper half of a body according to claim 1, wherein the distortion reducing portion is disposed at a position corresponding to the seventh and eighth thoracic vertebrae; and wherein the surrounded portions are each formed into a rhombus.

3. The clothing for the upper half of a body according to claim 1, wherein at least one pair of the strip portions extend from respective positions corresponding to the left and right shoulders of the wearer to obliquely lower sides.

4. The clothing for the upper half of a body according to claim 1, wherein a part of the main body cloth covering a lower side of the back of the wearer is further formed with strip portion pairs having respective apexes at positions corresponding to the fourth and fifth lumbar vertebrae of the wearer and extending laterally therefrom to obliquely lower sides.

* * * * *